United States Patent [19]

Kraemer et al.

[11] Patent Number: 4,596,436

[45] Date of Patent: Jun. 24, 1986

[54] ELECTRICAL CONNECTOR HOUSING ASSEMBLY COMPRISING HOUSING FRAME CONTAINING HOUSING MODULES

[75] Inventors: Rudolf E. Kraemer, Lautertal; Werner Moritz, Kleinostheim, both of Fed. Rep. of Germany

[73] Assignee: AMP Incorporated, Harrisburg, Pa.

[21] Appl. No.: 715,432

[22] Filed: Mar. 25, 1985

[51] Int. Cl.[4] ..... H01R 13/436

[52] U.S. Cl. ..... 339/206 R; 339/186 M; 339/198 H; 339/217 R; 339/219 R

[58] Field of Search ..... 339/206 R, 206 P, 186 R, 339/186 M, 198 R, 198 H, 217 R, 217 PS, 217 S, 191 R, 191 M, 210 R, 210 M, 207 R, 211, 219 R, 196 R, 196 M

[56] References Cited

U.S. PATENT DOCUMENTS

| | | | |
|---|---|---|---|
| 3,122,407 | 2/1964 | Cowe | 339/217 R |
| 3,503,035 | 3/1970 | Lazar et al. | 339/219 R |
| 3,760,336 | 9/1973 | Cerwin | 339/206 P |
| 4,400,049 | 8/1983 | Schuck | 339/217 R |
| 4,422,706 | 12/1983 | Neuhouser | 339/208 |

*Primary Examiner*—Gil Weidenfeld
*Assistant Examiner*—Thomas M. Kline
*Attorney, Agent, or Firm*—Frederick W. Raring

[57] ABSTRACT

Electrical connector housing assembly 2 comprises a frame 26 which contains a plurality of individual housing modules 28, 30, 32 which are received in openings 34, 35 in the frame. The modules each have contact-receiving cavities 46, 70 in which contact terminals are positioned. For each module, a single key 62, 88 is provided which extends through the housing frame 26 and through the housing modules 28, 30, 32. The key 62, 88 serves to secure the module to the frame and to positively retain the individual terminals in their cavities in the modules.

14 Claims, 9 Drawing Figures

ELECTRICAL CONNECTOR HOUSING ASSEMBLY COMPRISING HOUSING FRAME CONTAINING HOUSING MODULES

FIELD OF THE INVENTION

This invention relates to electrical connector assemblies of the type comprising a frame which contains a plurality of connector modules, each of which has electrical terminals therein. The invention particularly is concerned with improved retaining means for retaining the modules in the frame and for retaining the contact terminals in the modules. The invention also relates to module keying systems for keying the individual modules to particular module-receiving openings in the frame.

BACKGROUND OF THE INVENTION

The term "electrical connector" as used in this description refers to a housing containing a plurality of electrical contact terminals which is intended to be coupled or mated to a complementary electrical connector to form a connector assembly. One type of electrical connector is in the form of a housing assembly which consists of a frame or shell having one or more module-receiving openings in which is positioned a connector module. Housing assemblies of this type are being used to an increasing extend in electrical harnesses and have advantages over conventional connector housings under some circumstances. For example, the housing frame or shell can be of a standard configuration and size and the individual modules can be designed to accommodate different types or sizes of terminals so that standardization is achieved of the exterior dimensions and shape of the housing while permitting the use of many different types of terminals in the housing. Also, harnesses can be manufactured by producing individual modules containing all of the types of terminals required in the harness and the individual modules can then be brought together in a standard type of housing frame.

Connector housing assemlbies of the type comprising a frame and modules require a system for removably retaining the individual modules in the frame in a positive manner which nonetheless permits removal of the individual modules for servicing or repair. In accordance with one aspect thereof, the present invention is directed to the achievement of an improved module-retaining means for retaining individual connector modules in a housing frame of a connector housing assembly.

In accordance with a further aspect thereof, the invention is directed to the achievement of an improved retaining system for retaining individual contact terminals in their cavities in an electrical connector. Terminals are frequently retained in the cavities of an electrical connector by means of lances or tangs on the terminals which engage shoulders in the cavities. However, there is an increasing demand for a retaining system which is more reliable than the retaining lances which have frequently been used in the past. For example, if the terminals are quite small and produced of relatively thin gage sheet metal, the lances are somewhat flimsy and can be damaged during normal handling prior to their being placed in the connector and the terminals may be removed if a tensile force is applied to the wire to which the terminal is crimped. In order to overcome the weaknesses or retention lances as retainers for terminals in connectors, it is common practice to provide a separate retainer which is assembled to the housing assembly and which provides a constricted area in the terminal-receiving caivty that locks or secures the terminal in the caivty. The present invention is thus directed to the achievement of an improved terminal retainer in combination with a retaining system for the modules in the connector assembly as described above.

THE INVENTION

The invention comprises an electrical connector housing assembly of the type comprising a housing frame and at leat one housing module of insulating material contained in the frame. The housing assembly has a mating face, a rear face which is directed oppositely with respect to the mating face, and external wall portions which extend from the mating face to the rear face. At least one module-receiving opening extends through the housing from the rear face to the mating face and a housing module is contained in the opening. The module has a module mating face, a module rear face, and module external wall portions. At least one contact-receiving cavity extends through the module and a contact terminal is contained in the cavity. The connector housing assembly is particularly characterized in that a removable locking key extends into the external wall portions of the frame, into the module-receiving opening, and through the module. The locking key also extends through the contact-receiving cavity in the module. The locking key and the module have opposed module-retaining surface portions which prevent removal of the module from the frame. The locking key and the terminal have opposed contact-retaining surface portions which prevent removal of the terminal from the terminal-receiving cavity.

In accordance with a further embodiment, the external wall portions of the frame comprise first and second oppositely facing frame sidewalls and oppositely facing frame endwalls, and the locking key extends into the frame from the first frame sidewall. A plurality of module-receiving openings may be provided in the frame with the openings in side-by-side relationship in a row which is between the frame endwalls, and a locking key may then be provided for each of the module-receiving openings, the locking keys extending into the frame from one of the frame sidewalls.

In accordance with further embodiments, one or more of the modules has at least two contact-receiving cavities extending therethrough, each of the cavities having a contact terminal therein, and the locking key extends through all of the contact-receiving cavities. Each of the terminals and the locking key have opposed contact-retaining surface portions for retaining the terminals in the cavities. In one embodiment, the module has internal wall portions which are between the contact-receiving cavities and the locking key extends through the internal wall portions and projects into each of the cavities.

In accordance with a further embodiment, two modules are contained in at least one of the module-receiving openings and the locking key extends through both of the modules and through the contact-receiving cavitives in both of the modules.

THE DRAWING FIGURES

Figure 3:
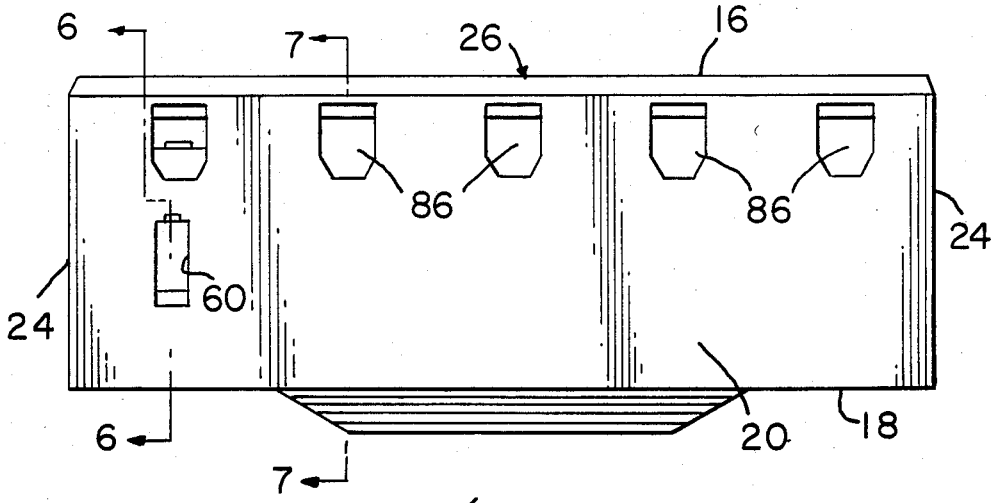
FIG. 3 is a top plan view of the housing assembly.
Figure 6:
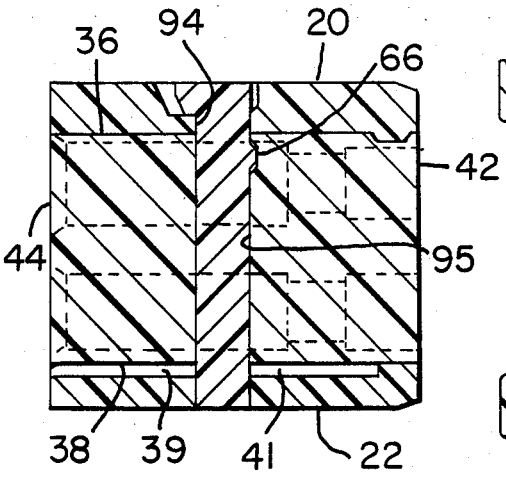
Figure 7:
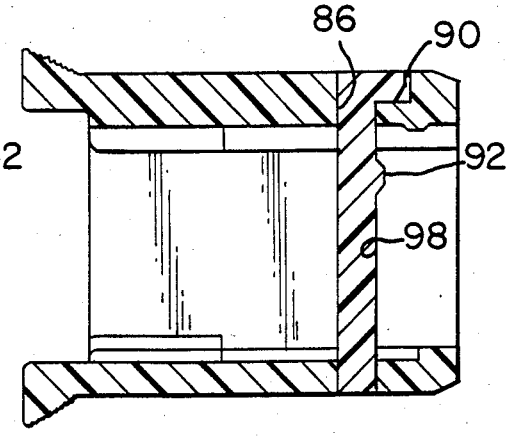

FIGS. 6 and 7 are views looking in the direction of the arrows 6—6 and 7—7 of FIG. 3.

Figure 2:
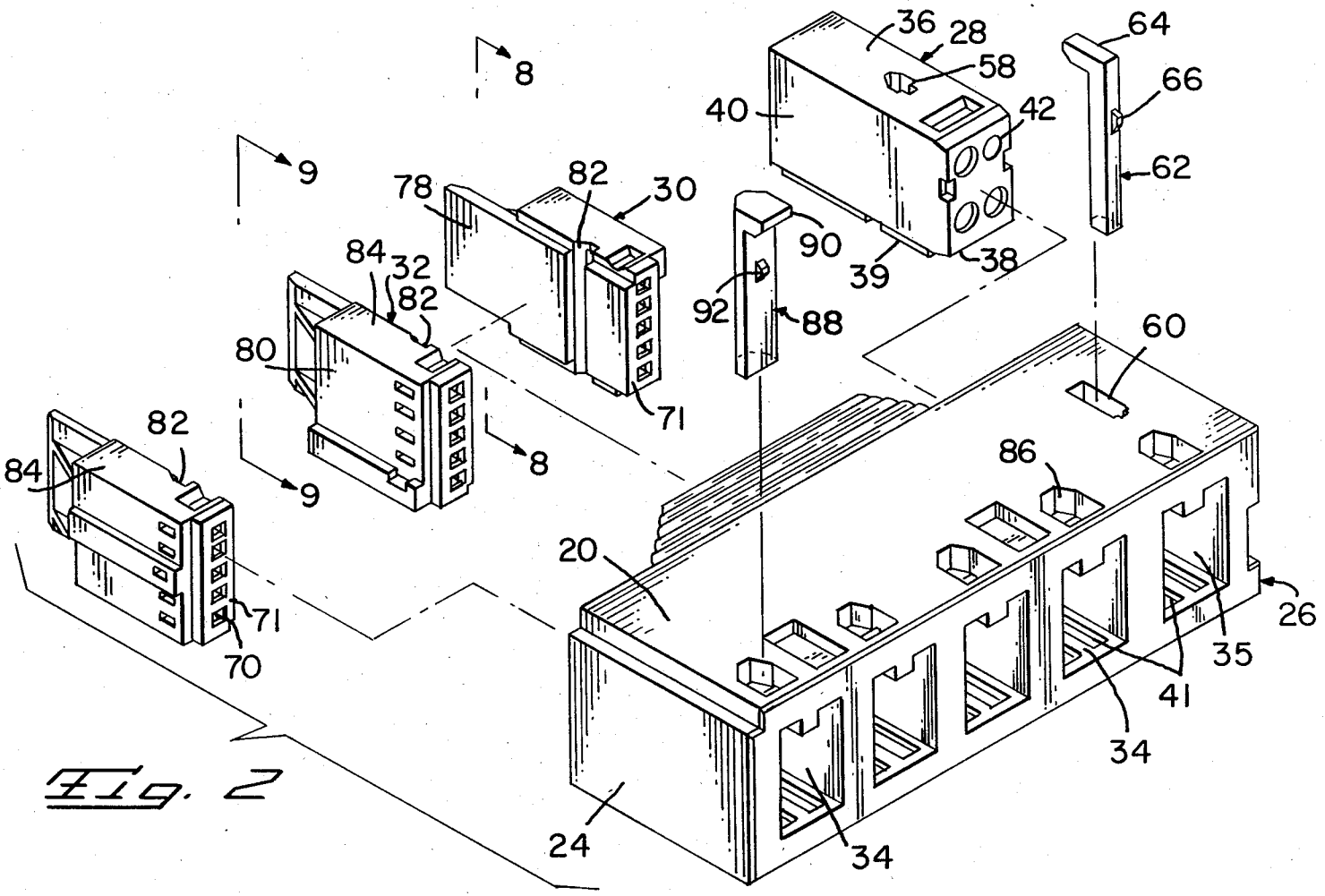
FIG. 2 is a perspective view showing a connector housing assembly having the modules and the locking keys exploded from the frame member.
Figure 8:
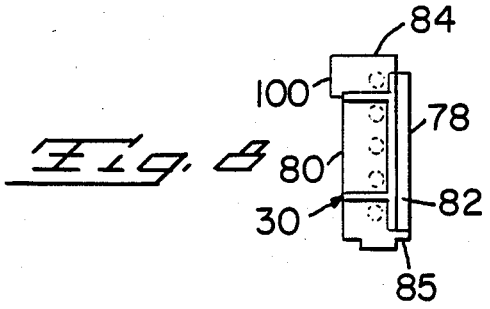
Figure 9:
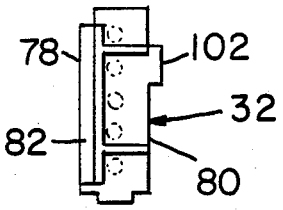

FIGS. 8 and 9 are views looking in the direction of the arrows 8—8 and 9—9 of FIG. 2 and showing the rearward faces of two of the modules which are contained in the frame.

THE DISCLOSED EMBODIMENT

Figure 1:
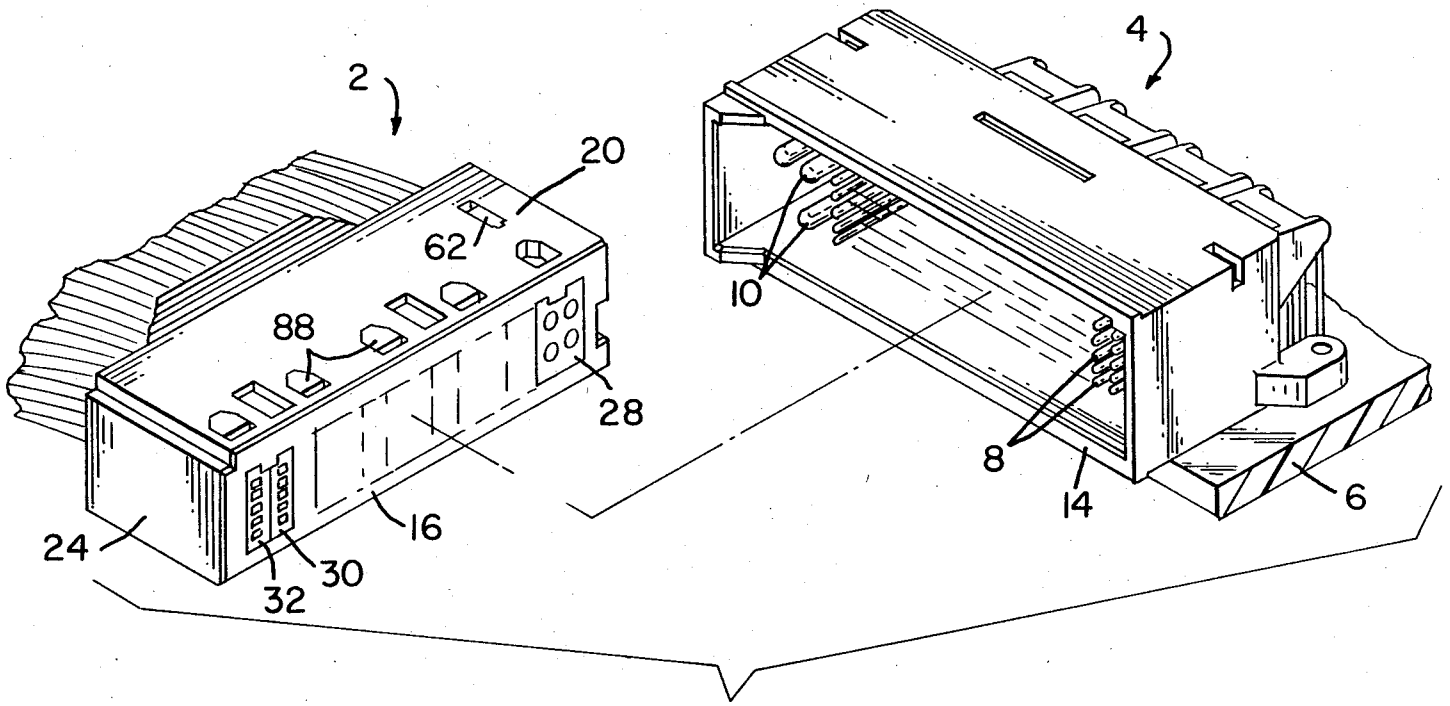
FIG. 1 is a perspective view showing a connector housing assembly in accordance with the invention and a complementary connector housing assembly.

An electrical connector housing assembly 2 in accordance with the invention, FIGS. 1 and 2, is intended to be coupled to a complementary connector housing 4 which is mounted on a circuit board 6. The complementary connector housing 4 contains a plurality of small contact pins 8 and larger contact pins 10 which extend forwardly from its mating face 12. A hood 14 surround the mating face 12, FIG. 5, and the connector housing assembly 2 is dimensioned to be received in this hood when the two connector assemblies are coupled to each other.

The housing assembly 2 has a mating face 16, a housing assembly rear face 18, upper and lower housing assembly sidewalls 20, 22, and oppositely facing housing assembly endwalls 24.

The housing assembly is composed of a housing frame 26 which contains one module 28 and a plurality of associated pairs of modules 30, 32. Module-receiving openings 34 extend through the frame and re dimensioned to receive a pair of modules 30, 32 and a single module-retaining opening 35 is provided for the module 28.

The module 28 has upper and lower module sidewalls 36, 38 and oppositely facing module endwals 40. Spaced-apart ribs are provided on the lower module sidewalls as shown at 39 and are received in spaced-apart channels 41 on the floor of the module-receiving opening. These channels have inner ends which are spaced from the mating face thereby to provide a forward stop for the module when it is inserted into the module-receiving opening 35. Terminal-receiving cavities 46 extend through the module 28 between the mating face 42 and the rear face 44 thereof. The disclosed embodiment has three such terminals intended to be mated with the three contact pins in the complementary housing 4.

Each of the terminals has a crimp portion 50 by means of which is secured to a wire, an intermediate collar 52, and a socket portion 54 which is adjacent to the mating face. It will be noted that the socket has rearwardly extending lances, see FIG. 5, which will retain the terminal in the cavity. However, and as will be described below, in accordance with the present invention an additional and more reliable terminal-retaining system is provided.

Figure 5:
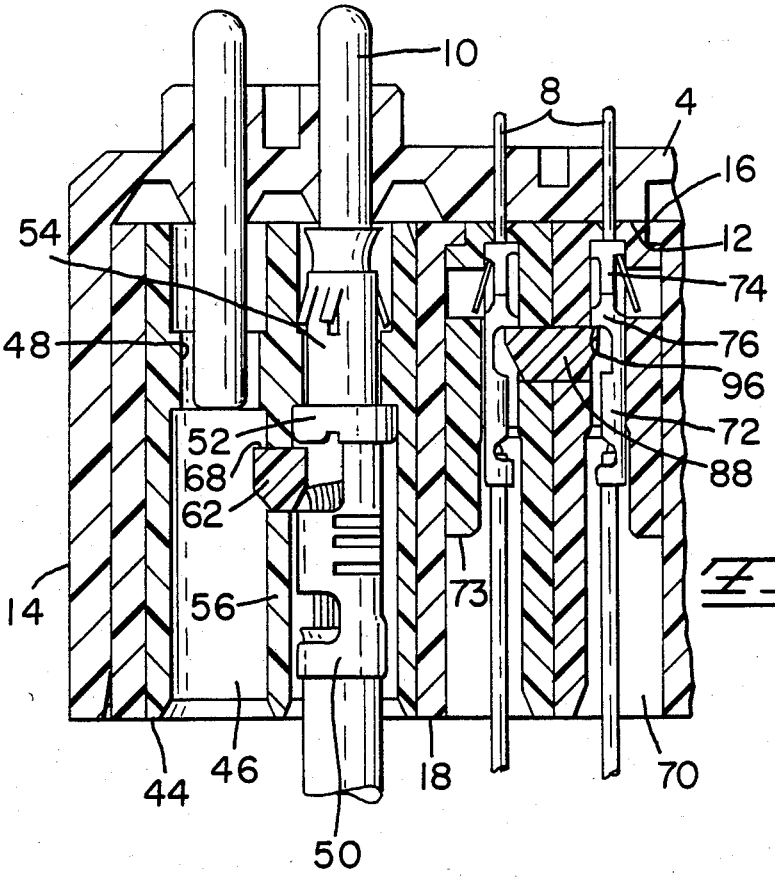
FIG. 5 is a view looking in the direction of the arrows 5—5 of FIG. 4 but showing modules contained in the module-receiving openings of the frame.

The module 28 has a vertically extending internal wall 56 which is between the cavities and an opening 58 is provided in the upper sidewall 36 which extends into this internal wall 56. An opening 60 is provided in the upper or first frame sidewall in alignment with the opening 58. The openings 58, 60 are dimensioned to receive a locking key 62 which has a head 64 that is received in the enlarged upper end of the opening 60 when the key is assembled to the frame and the module, see FIG. 6. The key and the internal wall of the module have a projection and recess as shown at 66, to retain the key in the openings when it is assembled to the module and the frame. As will be apparent from FIG. 6, the key can be removed by inserting the blade of a screwdriver or the like beneath the head 64 and raising the key upwardly. The key serves as a retainer for the terminals in the cavities 46 as shown in FIG. 5. The key has portions 68 which project into the terminal-receiving cavities and which are behind the collars 52 of the terminals so the terminals cannot be withdrawn from the cavities. Forward motion of the terminals is of course prevented by the constricted intermediate portions of the cavities. The key 62 also serves to retain the module in the module-receiving opening by virtue of the opposed shoulder surfaces shown in FIG. 6 at 94 and 95, between the shell and the key and the inner wall of the module and the key.

The modules 30, 32 are similar to each other and are substantial mirror images of each other, and the same reference numerals will therefore be used to identify the same structural features of the two modules.

The module 30 and the module 32 have terminal-receiving cavities 70 which extend through the module from the mating face 71 to the rear face 73 thereof. The terminals 72 in the cavities, see FIG. 5, have socket portions 74 and intermediate portions 76 which define shoulders that cooperate with the locking keys 88. It will be noted that these terminals also have lances for retention purposes although the locking key 88 serves as a more positive and reliable retaining means as will be described.

Each of the modules 30, 32 has an endwall 78 and an endwall 80. When the two modules are against each other, the endwalls 78 are against each other and aligned recesses 82 in these endwalls define an opening extending downwardly through the pair of modules which receive the locking key as illustrated in FIGS. 5 and 7. The key-receiving recess extends entirely through the pair of modules 30, 32 from the top sidewalls 84 of the modules to the bottom sidewalls 85 thereof.

An opening 86 is provided in the shell for the key 88 which has an enlarged upper end 90. The opening is also enlarged at the upper end, as shown in FIG. 7, so that the key can be removed as previously described. Again, a detect system is shown at 92 in FIG. 7 to retain the key in the modules. The key prevents removal of the modules from the module-receiving opening by virtue of the face that the key and the modules have opposed shoulder surfaces as shown at 98 in FIG. 7. Additionally, the key functions as a retainer for the terminals in that it has portions 96 which project into the terminal-receiving cavities of the modules 30, 32 ad which are behind the intermediate portions 36 of the terminals.

Figure 4:
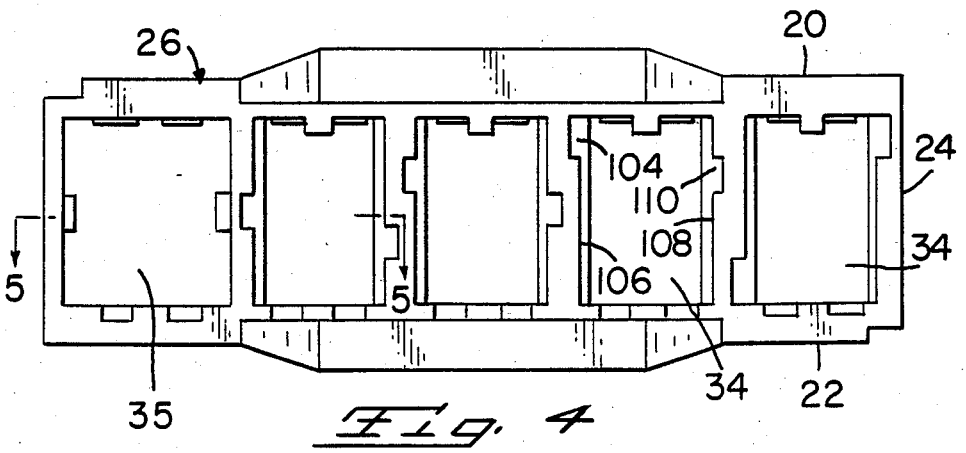
FIG. 4 is a view looking in the direction of the arrows 4—4 of FIG. 3.

The disclosed embodiment has a positioning or locating keying system on the modules 30, 32 and on the opposed walls 106, 108 of the module-receiving openings 34. This locating keying system comprises projections 100 on the module 30 and a recess 104 on the opening wall 106. Similarly, a projection 102 is provided on the module 32 and an opening 110 is provided in the wall 108. As illustrated by FIG. 4, these openings for the projections of the modules are located at different positions on the walls of the openings so that a given module can be inserted into only one of the positions available to it in the housing frame.

Connector assembly housings in accordance with the invention offer particular advantages in many circumstances where harnesses are produced by the assembly to each other of harness subassemblies. For example, each of the modules 30, 32 and the module 28 may be manufactured with suitable automatic and semiautomatic machinery. The modules can then be brought together at a central point and assembled to the frame, and because of the position keying system of the modules, an individual module 30 or 32 can be assembled to the frame only in a precisely predetermined location. The module 28 need not have such a position keying system since it is the only module in the frame 26. However, a similar position keying system can be provided where more than one module 28 is contained in the frame.

After the modules have been assembled to the frame, they are securely held in the frame and in addition the locking keys serve to ensure that the terminals will be retained in their terminal-receiving cavities in the modules. In fact, the finished connector assembly can be inspected merely by noting whether the modules are in place and the locking keys are inserted into the openings in the frame member. The locking keys clearly cannot be inserted unless all of the terminals have been properly inserted into the cavities and all of the modules have been properly inserted into the frame. At the same time, the locking keys can be individually removed if desired for purposes of servicing or repair.

It will be apparent from the foregoing that an improved modular connector housing assembly has been described which is extremely versatile and which offers improved reliablity and safety.

We claim:

1. An electrical connector housing assembly of the type comprising a housing frame and at least one housing module of insulating material contained in the frame, the housing assembly having a mating face, a rear face which is directed oppositely with respect to the mating face, and external wall portions which extend from the mating face to the rear face, the external wall portions comprising oppositely facing first and second frame sidewalls and oppositely facing frame endwalls, at least one module-receiving opening extending through the housing frame from the rear face to the mating face, a housing module inserted into the opening, the module having a module mating face, a module rear face and module external wall portions, at least two contact-receiving cavities extending through the module from the module rear face to the module mating face, and a contact terminal in each of the cavities, the connector housing assembly being characterized in that:

a removable locking key extends through the external wall portions of the frame, into the module-receiving opening, through the module, and through the contact-receiving cavities in the module, the locking key and the module having opposed module-retaining surface portions which prevent removal of the module from the frame, the locking key and the terminals having opposed contact-retaining surface portions which prevent removal of the terminals from the terminal-receiving cavities whereby the terminals are retained in the cavities and the module is retained in the frame by the locking key.

2. An electrical connector housing assembly as set forth in claim 1 characterized in that the locking key extends into the frame from the first frame sidewall.

3. An electrical connector housing assembly as set forth in claim 1 characterized in that a plurality of module-receiving openings extend through the frame, the module-receiving openings being in side-by-side relationship in a row which is between the frame endwalls.

4. An electrical connector housing assembly as set forth in claim 3 characterized in that a locking key is provided for each of the module-receiving openings, the locking keys extending into the frame from one of the frame sidewalls.

5. An electrical connector housing assembly as set forth in claim 1 characterized in that the module has internal wall portions which are between the contact-receiving cavities, the locking key extending through the internal wall portions and projecting into each of the cavities.

6. An electrical connector housing assembly as set forth in claim 5 characterized in that the frame has a plurality of module-receiving openings extending therethrough, and a module is contained in each of the openings.

7. An electrical connector assembly as set forth in claim 6 characterized in that the module-receiving openings are in side-by-side relationship in a row which is between the frame endwalls.

8. An electrical connector assembly as set forth in claim 7 characterized in that a locking key is provided for each of the modules and module-receiving openings, the locking keys extending into the frame from one of the frame sidewalls.

9. An electrical connector assembly as set forth in claim 1 characterized in that two modules are contained in the module-receiving opeing, the locking key extending through both of the modules and through the contact-receiving cavities in both of the modules.

10. An electrical connector housing assembly as set forth in claim 9 characterized in that the two modules have opposed module walls, the locking key extending through the opposed module walls and projecting into the cavities in both modules.

11. An electrical connector housing assembly as set forth in claim 10 characterized in that the frame has a plurality of module-receiving openings extending therethrough, and two modules are contained in each of the module-receiving openings.

12. An electrical connector housing assembly as set forth in claim 13 characterized in that a locking key is provided for the two modules in each module-receiving opening, the locking keys extending into the frame from one of the frame sidewalls.

13. An electrical connector housing assembly as set forth in claim 3 characterized in that the modules and the frame have integral positioning keys and keyways for positioning each of the modules in a predetermined module-receiving opening.

14. An electrical connector housing assembly as set forth in claim 9 characterized in that the modules and frame have integral positioning keys and keyways for positioning each of the modules in a predetermined module-receiving opening.

* * * * *